US010945565B2

(12) United States Patent
Kasten

(10) Patent No.: US 10,945,565 B2
(45) Date of Patent: Mar. 16, 2021

(54) REMOVABLE TOWEL FOR EXERCISE EQUIPMENT

(71) Applicant: Swan Athletic, LLC, Austin, TX (US)

(72) Inventor: Theodore Kasten, Austin, TX (US)

(73) Assignee: Swan Athletic, LLC, Austin, TX (US)

( * ) Notice: Subject to any disclaimer, the term of this patent is extended or adjusted under 35 U.S.C. 154(b) by 431 days.

(21) Appl. No.: 15/862,357

(22) Filed: Jan. 4, 2018

(65) Prior Publication Data

US 2018/0184858 A1 Jul. 5, 2018

Related U.S. Application Data

(63) Continuation of application No. 62/442,268, filed on Jan. 4, 2017.

(51) Int. Cl.

| | |
|---|---|
| ***A47K 10/02*** | (2006.01) |
| ***A63B 71/00*** | (2006.01) |
| *A63B 22/06* | (2006.01) |

(52) U.S. Cl.

CPC ..... *A47K 10/02* (2013.01); *A63B 71/00* (2013.01); *A63B 22/0605* (2013.01); *A63B 2225/68* (2013.01)

(58) Field of Classification Search

CPC .. A63B 2022/0658; A47K 10/02; B62B 5/069

See application file for complete search history.

(56) References Cited

U.S. PATENT DOCUMENTS

| | | | | |
|---|---|---|---|---|
| 9,795,856 | B2 | 10/2017 | Seilus | |
| 2005/0194502 | A1* | 9/2005 | Montgomery | F16M 13/00 248/174 |
| 2014/0205554 | A1* | 7/2014 | Beckman | A61F 7/00 424/65 |
| 2014/0342118 | A1* | 11/2014 | Connaughton | A63B 6/00 428/139 |
| 2015/0041603 | A1* | 2/2015 | Kinder | A47K 10/025 248/214 |
| 2016/0145786 | A1 | 5/2016 | Kinder | |

* cited by examiner

*Primary Examiner* — Maria V Ewald
*Assistant Examiner* — Daniel P Dillon
(74) *Attorney, Agent, or Firm* — DuBois, Bryant & Campbell, LLP; William D. Wiese

(57) ABSTRACT

A towel having three pockets which are configured to slip over the handle bars on fitness and exercise equipment. The towel covers the entirety of the handle bars and is removable, washable and reusable. The towel is made of an absorbent material and can be easily removed and used for wiping face and body during exercise.

11 Claims, 20 Drawing Sheets

REMOVABLE TOWEL FOR EXERCISE EQUIPMENT

PRIORITY STATEMENT UNDER 35 U.S.C. § 119 & 37 C.F.R. § 1.78

This non-provisional application claims priority based upon prior U.S. Provisional Patent Application Ser. No. 62/442,268 filed Jan. 4, 2017, in the name of Theodore Kasten entitled "REMOVABLE TOWEL FOR EXERCISE EQUIPMENT" the disclosures of which are incorporated herein in their entirety by reference as if fully set forth herein.

BACKGROUND OF THE INVENTION

Conventional rectangular cotton hand towels are currently used by individuals exercising on several different types of exercise equipment such as exercise bikes, such as that shown in FIG. 1, as well as elliptical machines and treadmills. These towels are not designed for any specific piece of exercise equipment and, as a result, do not attach to the equipment and are not easily removable for use.

By way of example, people lay conventional hand towels on the top of handlebars of an exercise bike for easy access while exercising. These towels are typically too small to cover the entirety of the handlebars. More importantly, nothing is used to prevent the towels from falling off the handlebars which happens frequently. Similar problems exist with the use of towels on other exercise equipment. For example, FIGS. 2A through 2D show how conventional towels are currently used on exercise bikes. FIGS. 2A and 2B show how towels do not cover the entirety of the handlebars. These towels are placed neatly on the top of the handlebars at the beginning of a cycling class. FIGS. 2C and 2D show how these conventional towels fall off all or part of the handlebars during exercise and become disorganized and a nuisance to keep on.

People having skill in the art have attempted to solve this problem using many different methods. For example, the towel shown in FIG. 3 serves as a "storage unit for use on a handlebar of a piece of exercise equipment, such as a spinning bike or cycling bike" as shown in U.S. patent application Ser. No. 11/021,880. This invention is intended to allow users to store personal items such as cell phones, IDs and the like on the support portion of invention but is not intended to be used as a towel itself. This invention is designed to be stretched over the handlebars to allow users to store items on top of the material, it is not designed to allow users to access water bottles or weights that may be stored in holders just below the handlebars. The towel does not cover the entire handlebars and it cannot be removed easily from handlebars during exercise to wipe sweat from face or body. As a practical matter, the user still requires the use of a conventional towel in addition to a towel having this configuration.

Similarly, FIG. 4A and FIG. 4B show the design of a "towel device for spin biking made from towel material that is sewed with two tunnel-like regions that slip over the bike's handlebars" as shown in U.S. patent application Ser. No. 14/924,345. This invention is intended to allow users to store personal items such as cell phones, IDs and the like in the pockets of invention. This invention is not designed to cover the entirety of the handlebars. Furthermore, if users are storing items in the pockets, it would be difficult to remove the device to wipe sweat from one's face or body during exercise.

There is a need, therefore, for a towel that may be removably attached to exercise equipment while being readily accessible to the user.

SUMMARY OF THE INVENTION

Various embodiments of the invention include a towel made from washable towel material custom designed to function with specific exercise equipment. The towel is designed based on the exact layout of the exercise machines handlebars such that the towel covers the entirety of the handlebars. Furthermore, embodiments of the invention include one or more "upside down pockets" on the bottom of the towel such that the towel hangs loosely from the handlebars but does not fall off during exercise. The loose fitting towel enables users to easily remove the towel completely to wipe sweat from their body during exercise. The loose fit also functions to enable users to easily lift parts of the towel, without removing it completely, to access water bottles, weights or other accessories stored under the towel and/or to grasp heart monitor sensors incorporated into the exercise equipment. The invention is designed to cover the entirety of the handlebars and not fall off during exercise, therefore it more adequately prevents the spread of germs and does not interrupt one's exercise regimen.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention is directed to improved methods and systems for, among other things, removable towels for exercise equipment. The configuration and use of the presently preferred embodiments are discussed in detail below. It should be appreciated, however, that the present invention provides many applicable inventive concepts that can be embodied in a wide variety of contexts other than removable towels for exercise equipment. Accordingly, the specific embodiments discussed are merely illustrative of specific ways to make and use the invention, and do not limit the scope of the invention.

Figure 1:
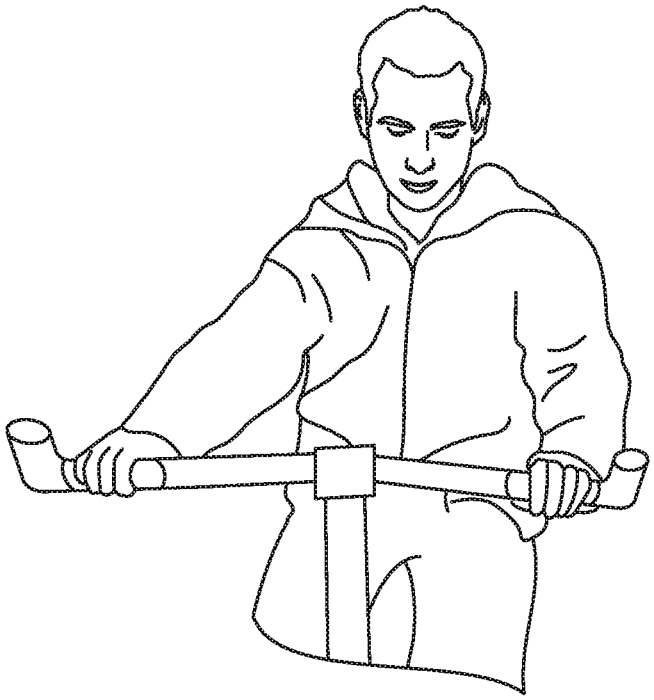
FIG. 1 depicts a front view of a rider on an exercise bicycle known in the art.
Figure 2A:
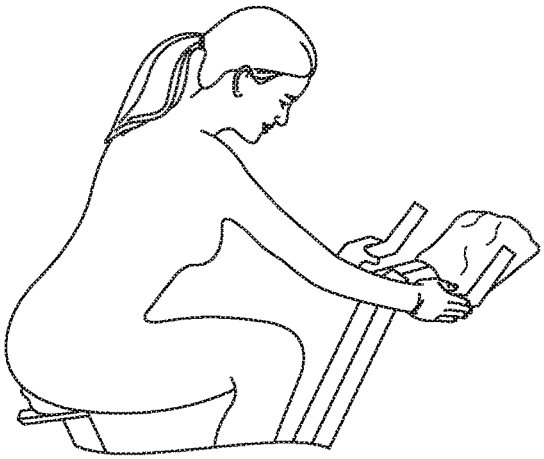
FIGS. 2A through 2D depict a towel known in the art that falls away from the bike during exercise.
Figure 2B:
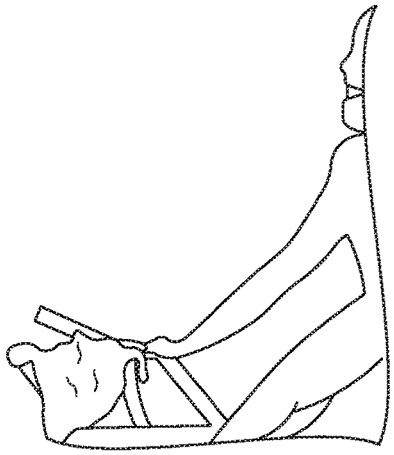
Figure 2C:
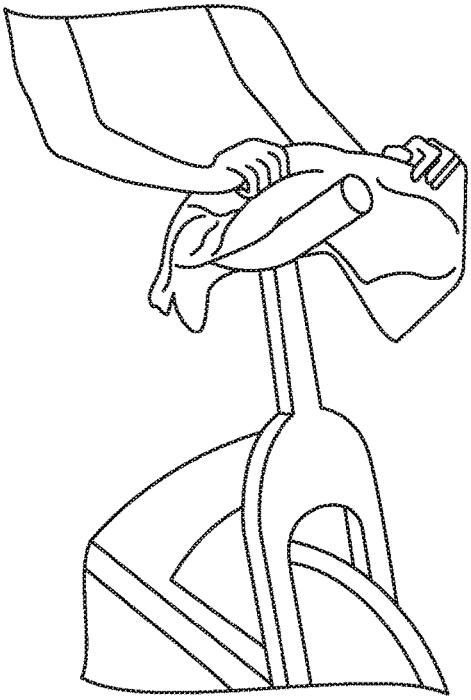
Figure 2D:
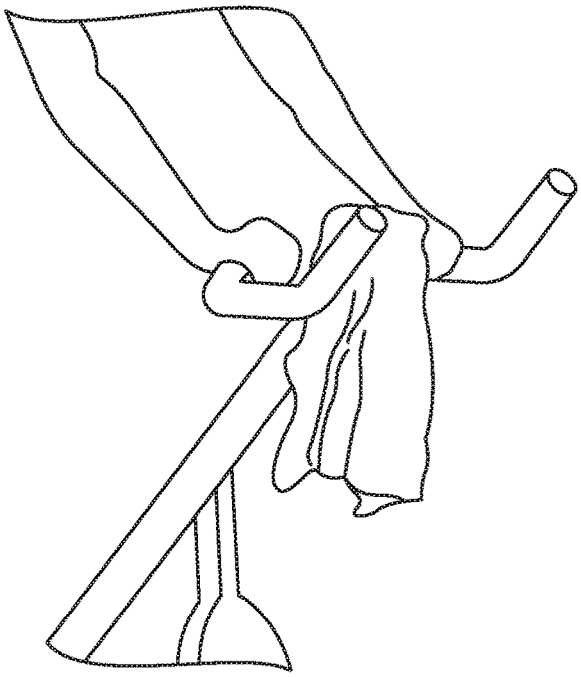
Figure 3:
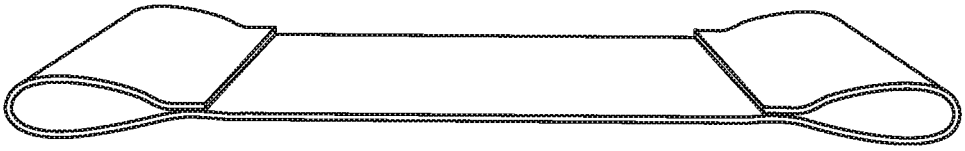
FIG. 3 depicts a design for a handlebar cover known in the art to be used on handlebars of exercise bikes.
Figure 4A:
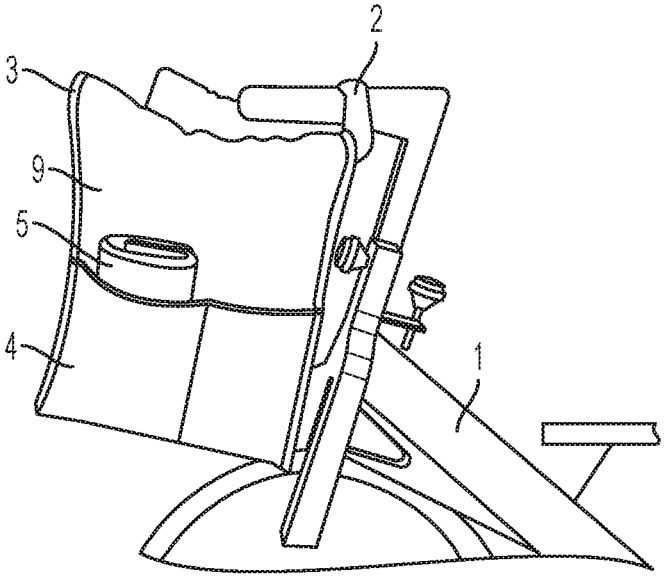
FIGS. 4A and 4B depict another design known in the art for a towel to be used on handlebars of an exercise bike that provides storage for personal items.
Figure 4B:
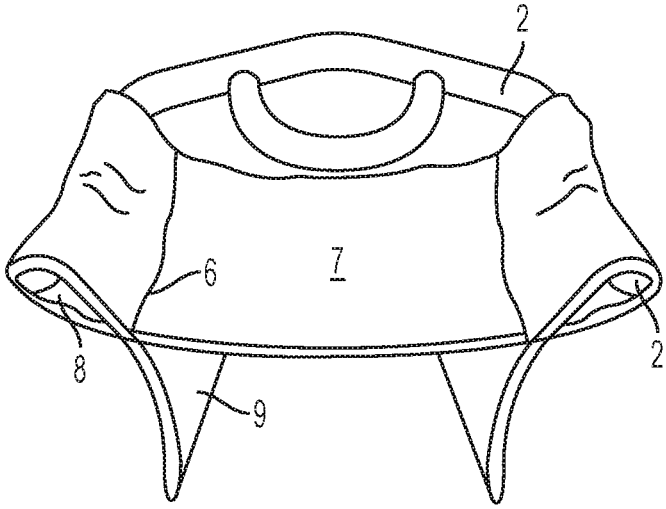
Figure 5:
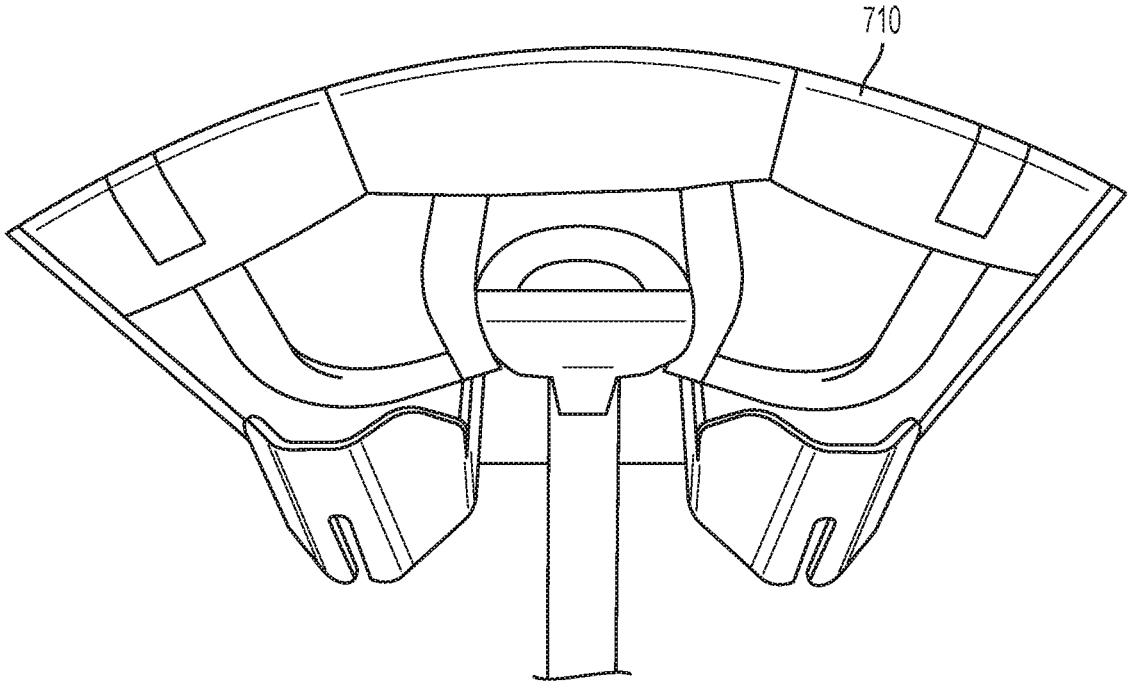
FIG. 5 depicts one embodiment of the present invention placed on the handlebars of an exercise bike.
Figure 6:
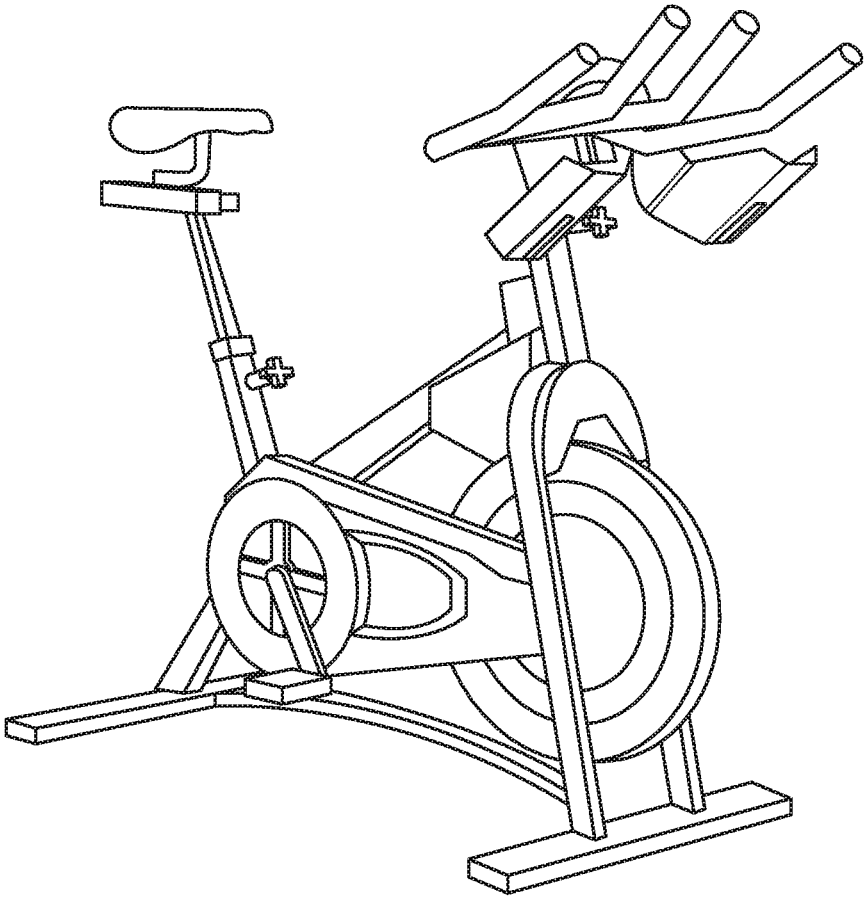
FIG. 6 depicts a typical exercise bike used in indoor cycling (or "spinning") classes.
Figure 7A:
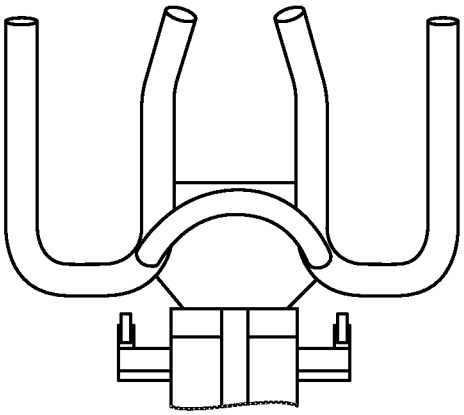
FIGS. 7A through 7D depict various handlebar designs used on exercise bikes.
Figure 7B:
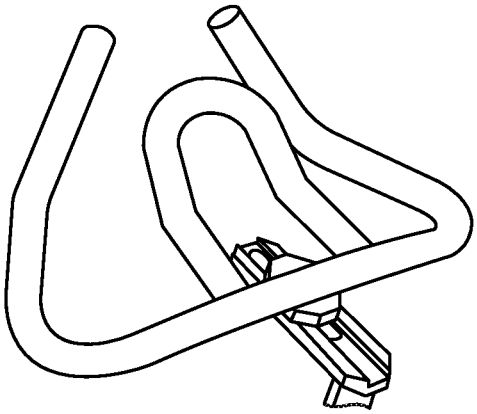
Figure 7C:
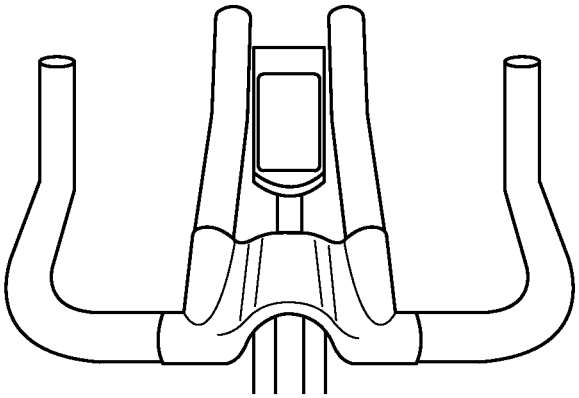
Figure 7D:
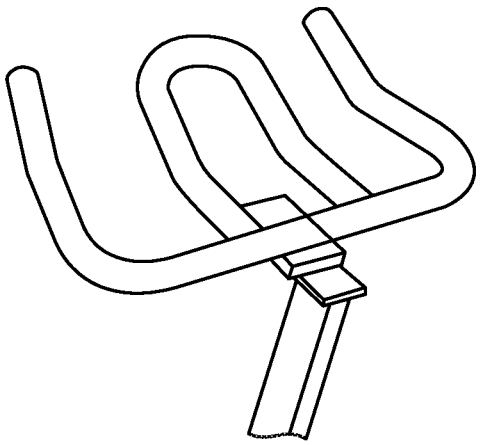
Figure 8A:
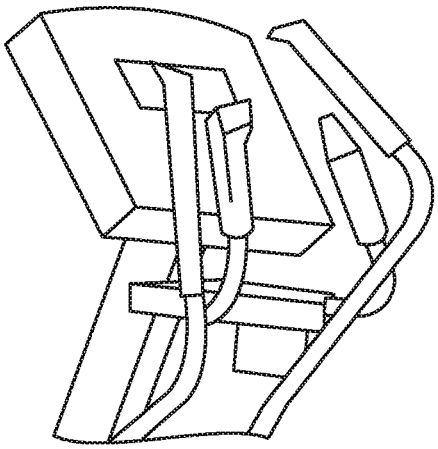
FIGS. 8A through 8C depict various handlebar designs used on elliptical exercise machines.
Figure 8B:
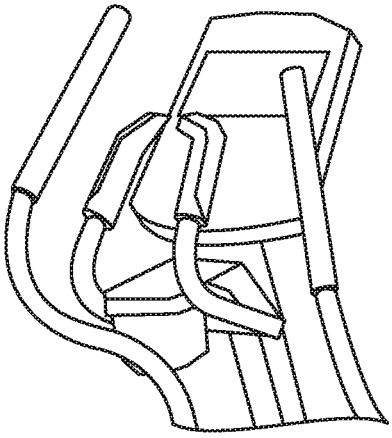
Figure 8C:
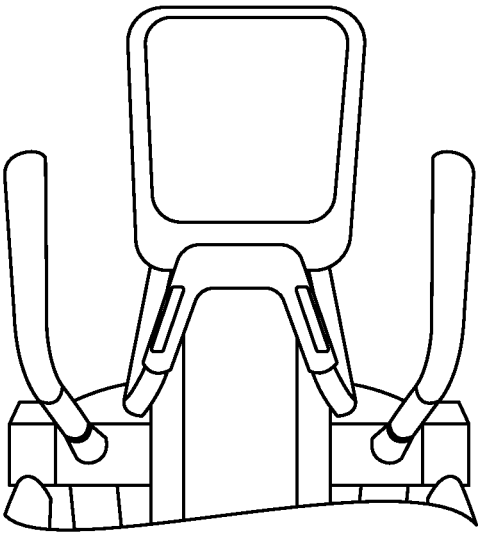
Figure 9A:
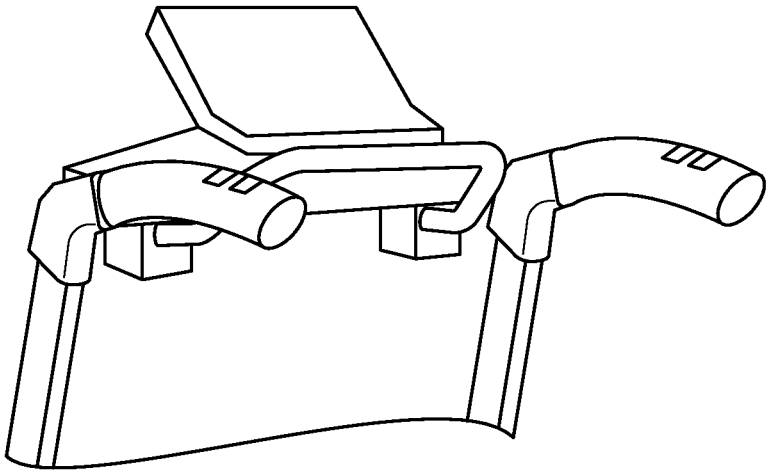
FIGS. 9A and 9B depict various handlebar designs used on treadmill exercise machines.
Figure 9B:
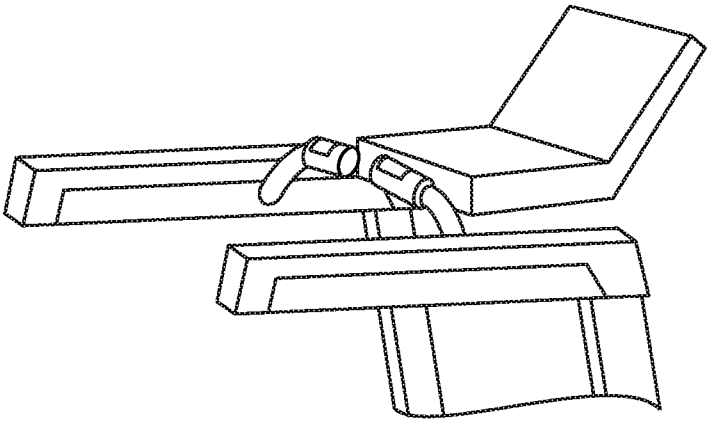

FIG. 5 illustrates one embodiment of the invention. As shown, various embodiments of the present invention are designed to function with specific handlebar assemblies of indoor exercise bikes, such as, for example, those shown in FIG. 6, as well as other bikes with similar handlebar designs. The functional aspects of the invention are meant to be applied to many common handlebar assemblies for indoor exercise bikes, such as, for example, those shown in FIGS. 7A through 7D, elliptical machines, such as, for example, those shown in FIGS. 8A through 8C and treadmill exercise machines, such as, for example, those shown in FIGS. 9A and 9B.

Figure 10:
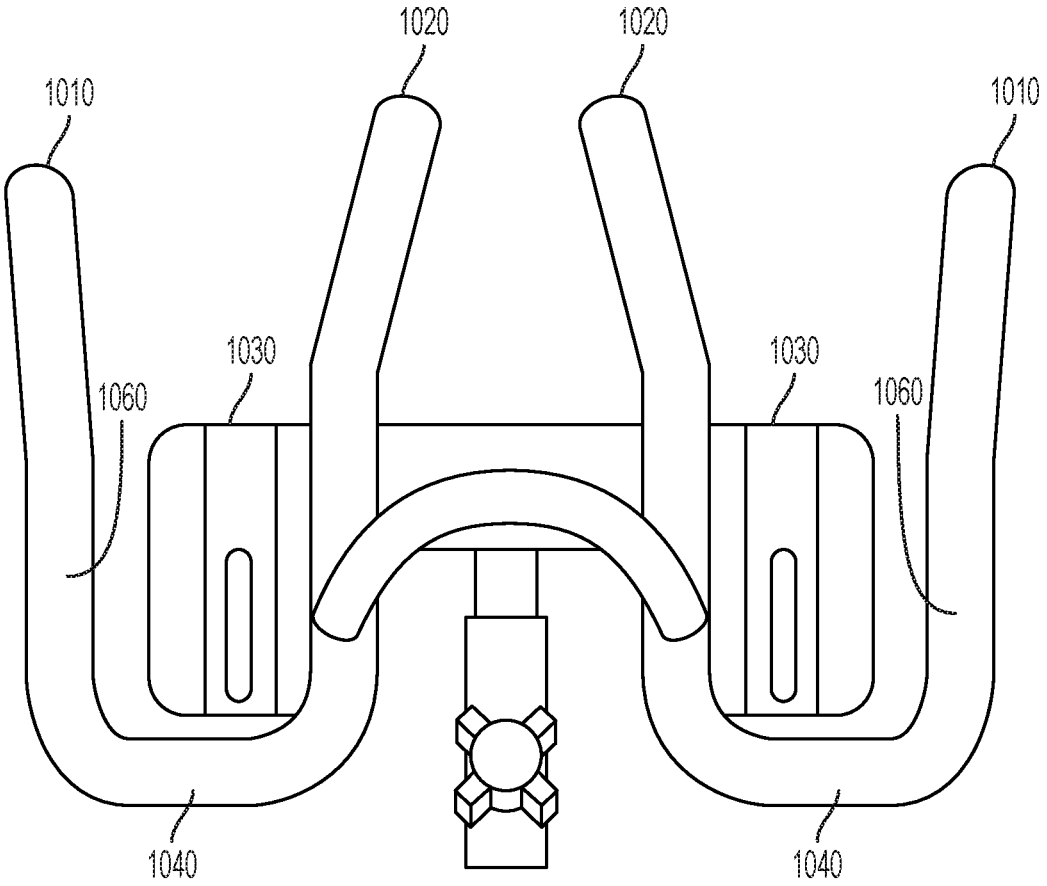
FIG. 10 depicts the layout of a handlebar for an exercise bike in which the different hand positions on the handlebar used during typical bike exercise regimens are identified.

FIG. 10 shows the different position on the handlebar that users typically place their hands during a cycling class, including "position 1" 1040, "position 2" 1060, and "position 3" 1010. The handlebar assembly may also include "aero bars" 1020, an arch 1050, and holders for water bottles 1030 or weights included on the handlebars.

Figure 11:
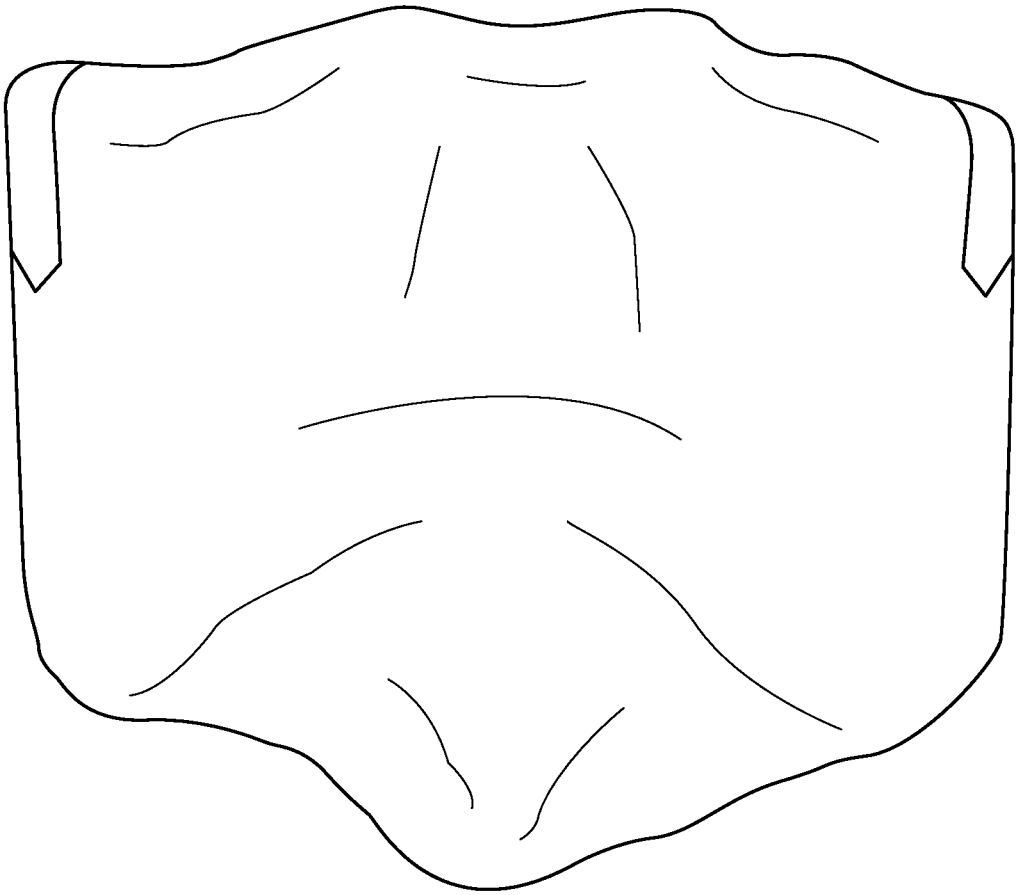
FIG. 11 depicts one embodiment of the present invention placed on the handlebars of an exercise bike as shown from above the handlebars, which is the user's perspective.
Figure 12:
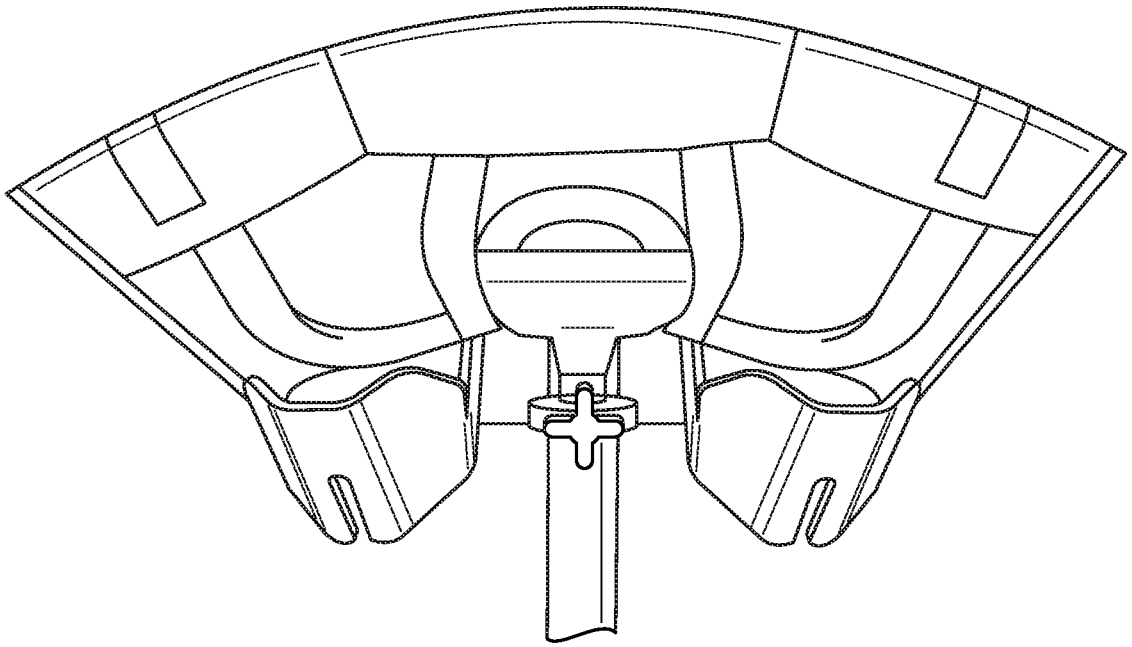
FIG. 12 depicts one embodiment of the present invention placed on the handlebars of an exercise bike as shown from below the handlebars.

As will be appreciated by those having skill in the art, the towel covers all hand positions on the handlebar assembly to help prevent the spread of germs. FIGS. 11 and 12 show one embodiment of the invention placed on top of the handlebar such that it covers the entire top of the handlebar assembly and all hand positions 1010 through 1060. Furthermore, the towel of the present invention is custom fit to stay on while also giving the user easy access to their accessories kept in holders 1030 during exercise.

Figure 13:
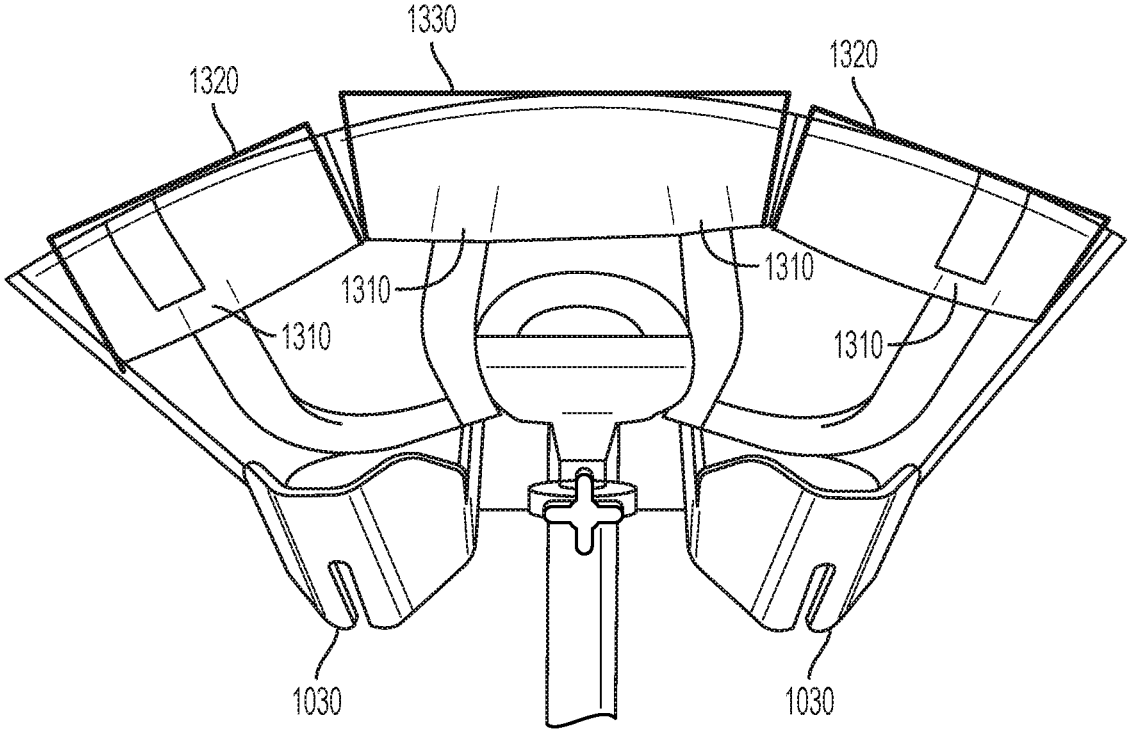
FIG. 13 depicts one embodiment of the present invention in which custom sized "upside down pockets" that prevent the towel from sliding off the handlebars.

As shown in FIG. 13, the towel includes unique custom sized "upside down pockets" 1320 and 1330 on the bottom of the towel designed to loosely hang over the top of the handlebars 1310. These pockets allow the towel to hang in place and prevent the towel from falling off during use.

Figure 14:
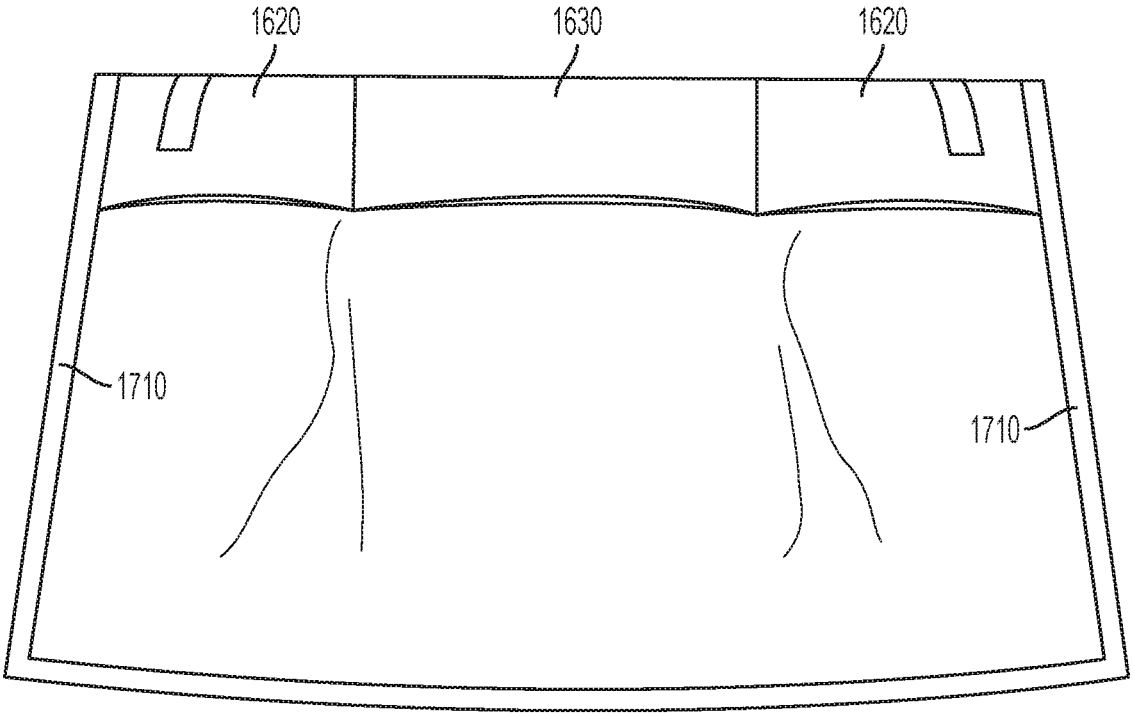
FIG. 14 depicts one embodiment of the present invention laying upside down and identifying the custom sized "upside down pockets" that fit loosely around the handlebars to prevent the towel from sliding off the handlebars, wherein the other three sides of the towel are left open with no pockets, fasteners or other attachment devices.
Figure 15:
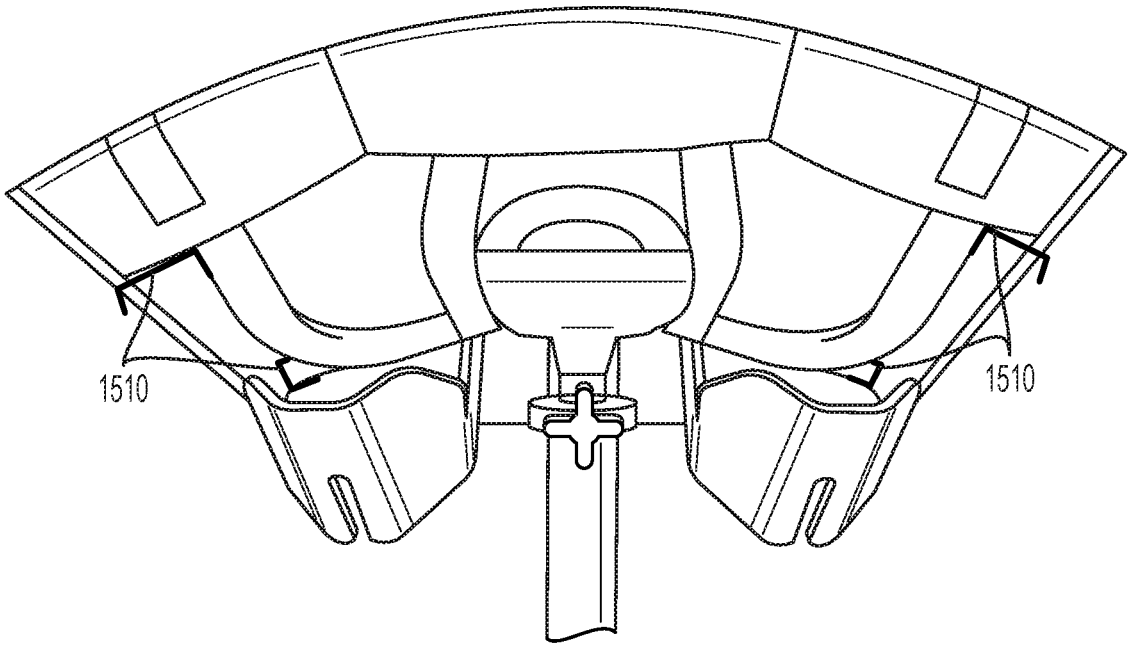
FIG. 15 depicts one embodiment of the present invention placed on the handlebars of an exercise bike as shown from below the handlebars.
Figure 16A:
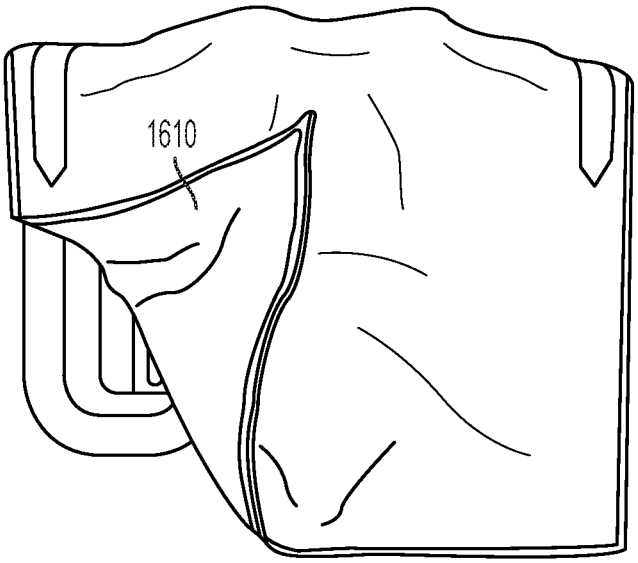
FIGS. 16A and 16B depict the open sides of the towel shown in the forgoing embodiments that provide easy access to accessories such as water bottles or weights.
Figure 16B:
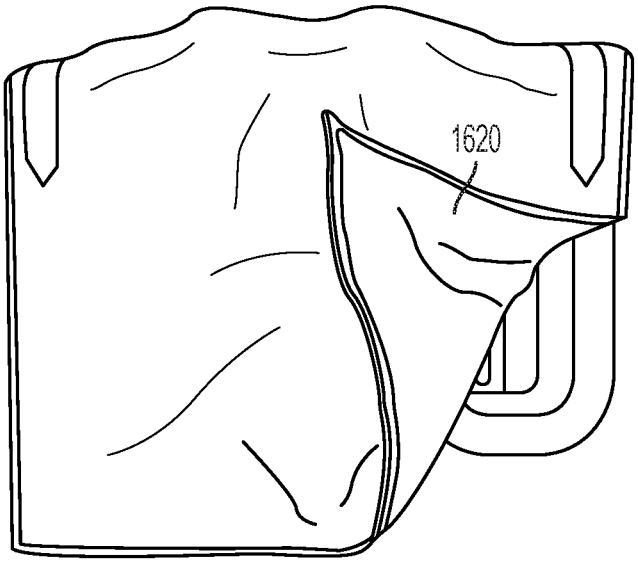

FIG. 14 shows one embodiment of the towel of the present invention when not in use, while FIG. 15 show the same towel hanging loosely about 1-3 inches 1510 over the outer edges of the handlebar. As shown in FIG. 16A and FIG. 16B, this design aspect functions to allow the user to easily lift the corners 1610 and 1620 of the towel up to reach accessories stored directly underneath the handlebars such as water bottles or weights. Users drink water frequently during the exercise regimen, so easy access to the water bottle is very important.

Figure 17:
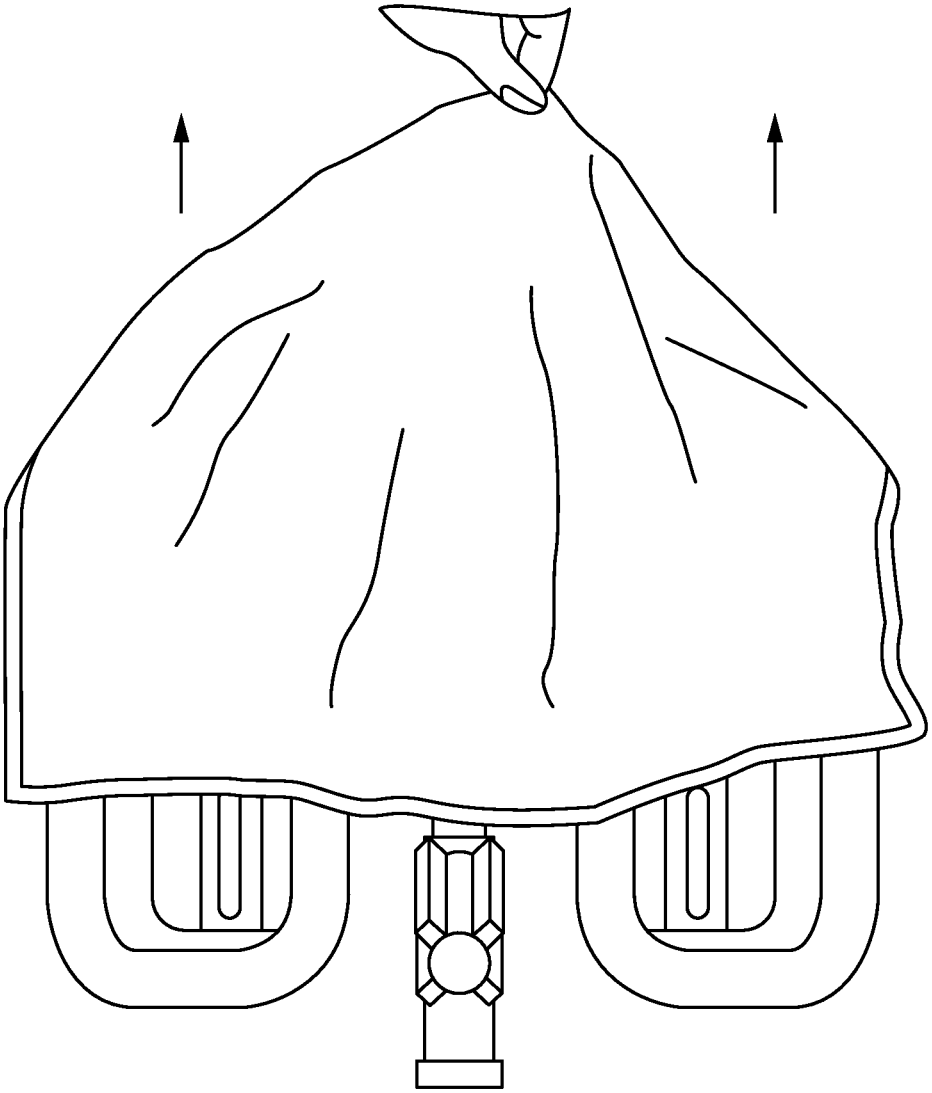
FIG. 17 is a depiction showing how one embodiment of the present invention can be easily removed with one hand.
Figure 18B:
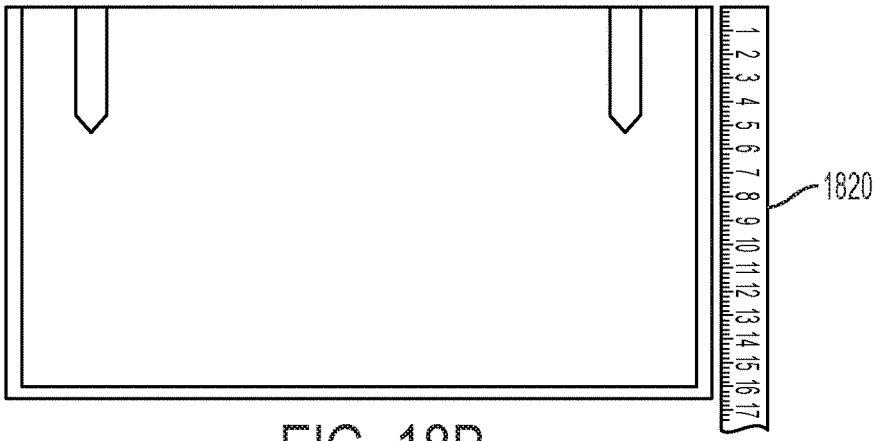
FIGS. 18A through 18D depict the design specifications, including height, width, pocket size and pocket spacing, of one embodiment of the present invention that has been designed for use with an exercise bike.
Figure 18D:
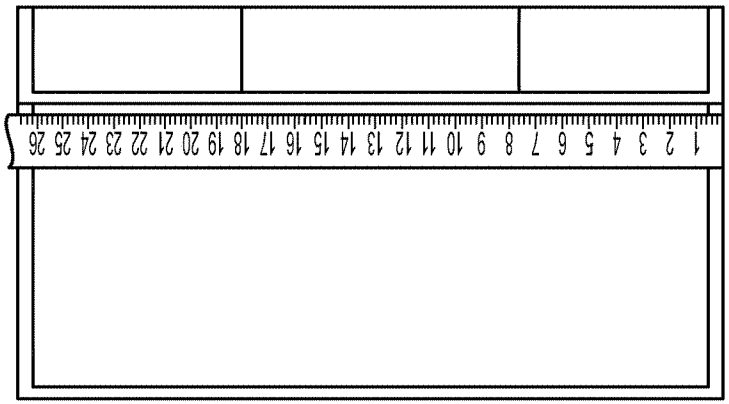
Figure 18A:
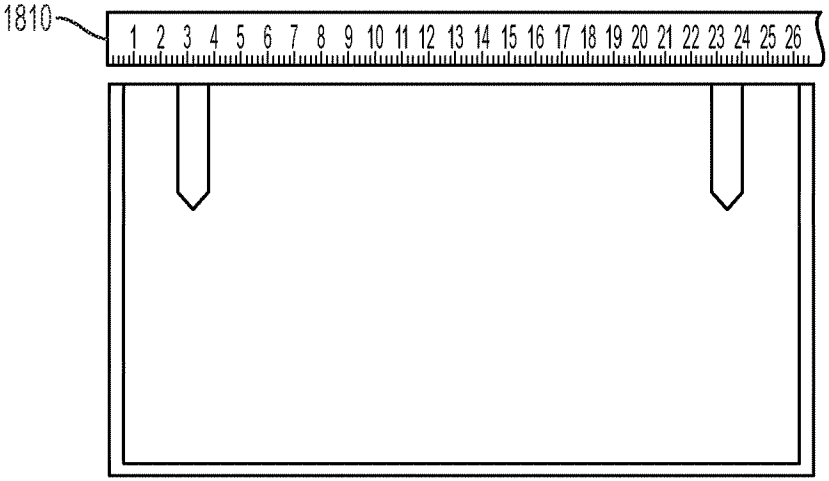
Figure 18C:
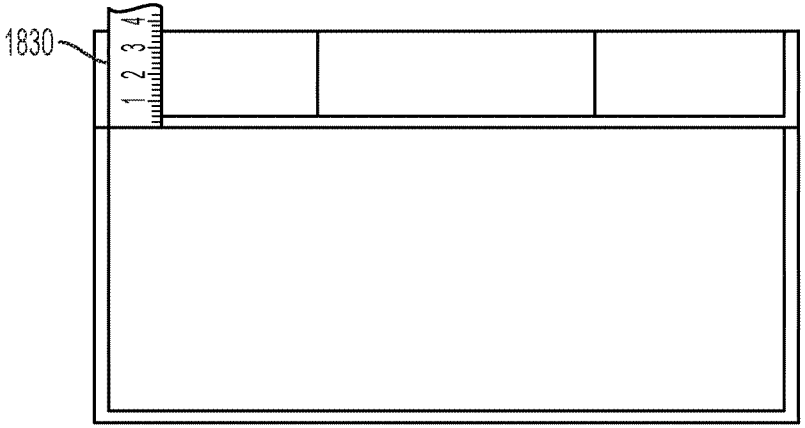

The loosely fitting "upside down pockets" also function to allow the user to easily slide the towel off as demonstrated in FIG. 17. The towel is designed to fit loosely over the top of the handlebars, but is not attached, wrapped or clipped to the handlebars in anyway. This allows the user to easily take the towel off and place it back on as desired during use. Users wipe sweat off their body with a towel frequently, so the ability to easily take the towel off the handle bars and easily place the towel back on the handlebars is very important.

FIGS. 18A through 18D show the approximate dimensions of one embodiment of the invention designed for a specific handlebar commonly used on exercise bikes. In this embodiment, the towel is approximately 26 inches wide 1810 by approximately 15 inches tall 1820. The primary function of these dimensions is to ensure the towel fully covers the handlebars with about 1-3 inches' overlay on the left, bottom and right sides. Furthermore, the left and right pockets on the bottom of the towel 1830 are approximately 3 inches deep by approximately 7.5 inches wide and the middle pocket is approximately 3 inches deep by approximately 11 inches wide.

The primary function of the depth and length of these pockets is to make sure the towel is easily removed and placed back on the handlebars with minimal interruption during exercise. If the depth of the pockets is too shallow, the towel is less likely to stay in place during exercise. If the depth of the pockets is too deep, the towel is likely to "catch" on the handlebars when being removed, increasing interruptions during exercise. If only one pocket were included in this design, the towel would not fit on the handlebars properly as it would sag in the middle. The three pockets function optimally to prevent the towel from falling off the handlebars while still allowing the user to easily remove the towel with minimal interruption during exercise. Various embodiments of the invention are designed with different dimensions and pockets to fit different exercise equipment.

Embodiments of the present invention are manufactured in many different shapes and sizes and utilize many different types of washable fabric such as cotton, polyester, nylon, performance fabrics and other materials. Fabric or fabric additives that may be used in the manufacturing of the towel further enhance its functions include, but are not limited to, the following:

- Anti-microbial fabric or fabric additives to prevent the spread of germs;
- Wicking technology to remove perspiration as quickly as possible;
- Cooling gels or polymers that use moisture activated cooling technology to help the user cool off during exercise; and
- Anti-static fabric or fabric additives to help with washing.

Certain embodiments of the invention include "upside down pockets" that are typically created using seems sewed directly into the material but could also be created using other methods such as Velcro fasteners, glue, buttons or other fasteners.

Figure 19A:
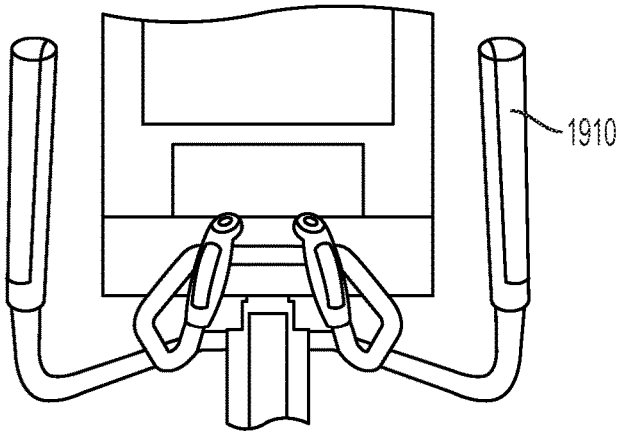
FIGS. 19A through 19D depict one embodiment of the present invention placed on the handlebars of a treadmill exercise machine.
Figure 19B:
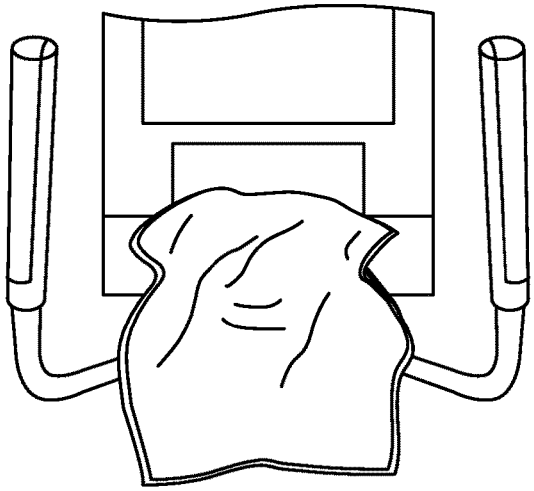
Figure 19C:
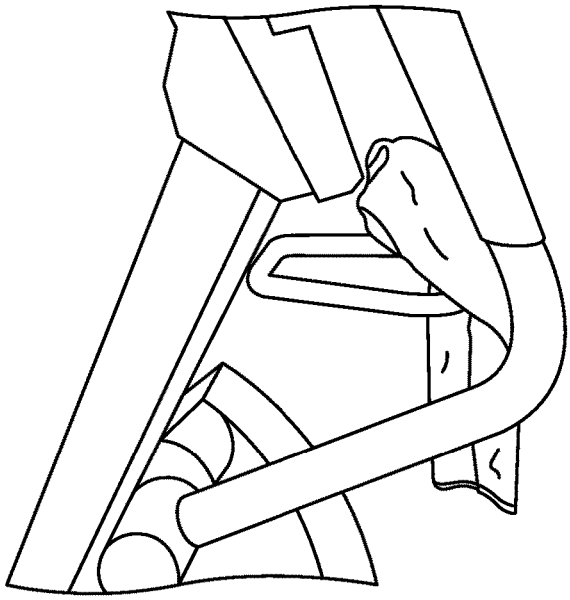
Figure 19D:
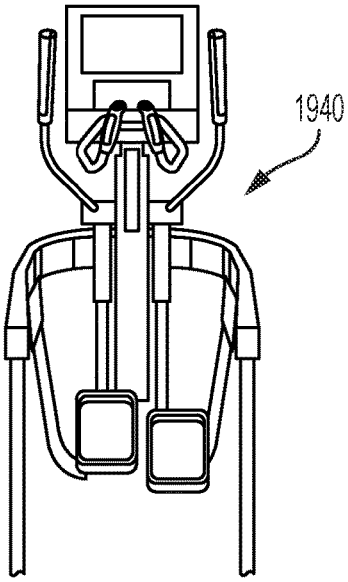

FIGS. 19A through 19D show one embodiment of the invention designed to function with specific handlebars 1910 of an elliptical exercise machine 1940. The towel is custom fit to cover the entire handlebars, as shown in FIG. 19B, and hang loosely from the top of the handlebars, as shown in FIG. 19B, to prevent the towel from falling off during exercise. To accomplish this the towel is designed with one pocket on the bottom of the towel that stretches the full width of the towel (whereas previously described towels have three "upside down pockets"). The handlebars 1910 of the elliptical machine are closer together than typical handlebars of exercise bikes, therefore only one "upside down pocket" is needed to fit optimally as opposed to three. The number of pockets included in the design of the towel will vary depending on the specific layout of the different handlebars the towel is designed for.

Figure 20A:
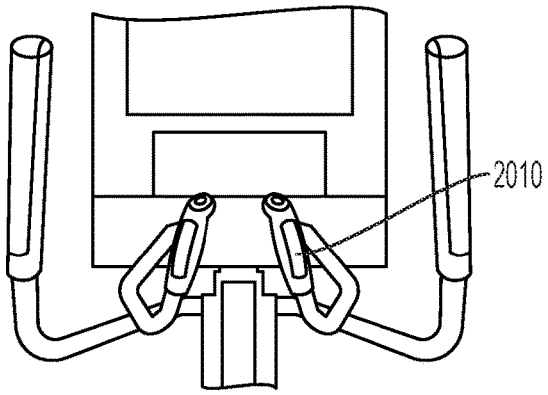
FIGS. 20A through 20C depict a user placing his hands directly on a heart monitor sensor underneath the towel without having to remove the towel.
Figure 20B:
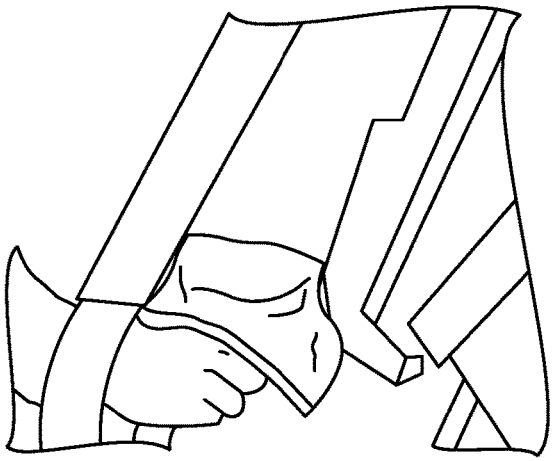
Figure 20C:
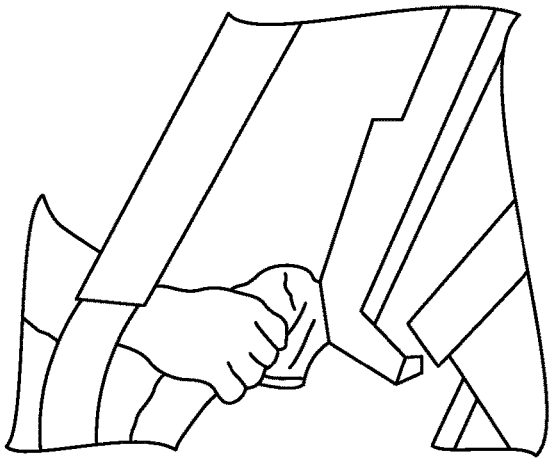

Referring now to FIG. 20, many exercise machines include heart rate monitor sensors 2010 on the handlebars. These sensors require the user to place both hands directly on the sensors to determine one's heart rate during exercise. The loosely fitting design aspect of the invention functions to allow users to easily slide their hands underneath the towel to grasp the handlebars directly without having to remove the towel as demonstrated in FIG. 20. When the user does not need to grasp the sensors, they can easily place their hands on top of the towel as demonstrated in FIGS. 20A through 20C.

Although this invention has been described in specific detail with reference to the disclosed embodiments, it will be understood that many variations and modifications may be effected within the spirit and scope of the invention as described. In particular, the invention will be designed with several different width and height dimensions as well as with differing size, placement and number of "upside down pockets" with the purpose of designing each towel to match the layout or several different types of handlebars used on different types of exercise equipment."

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for removable towels for exercise equipment known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

I claim:

1. A towel system for use with exercise and fitness equipment, comprising:

- a handle bar assembly including a first handle bar, a second handle bar, a cross bar connecting the first hand bar and the second handle bar, and aero bars connected to the cross bar;
- a towel having a series of pockets formed by folding a portion of the towel onto itself, including a first pocket configured to receive the first handle bar; a second pocket configured for receiving the second handle bar, and a third pocket located between the first pocket and the second pocket;
- wherein the first pocket and the second pocket are underneath the towel when in use, and the towel covers all of the top surface of the handle bar assembly when the first pocket is placed over the first handle bar and the second pocket has been placed over the second handle bar.

2. The towel system of claim 1, wherein the handle bar assembly is affixed to a stationary bicycle.

3. The towel system of claim 1, wherein the handle bar assembly includes aero bars and one or more water bottle holders.

4. The towel system of claim 1, wherein the towel measures approximately sixteen inches in length and the pockets have a depth of approximately three inches.

5. The towel system of claim 1, wherein a user can lift a corner of the towel to access accessories stored underneath the handle bar assembly after the first pocket over the first handle bar and the second pocket has been placed over the second handle bar.

6. The towel system of claim 1, wherein the towel is approximately twenty six inches wide and approximately 16 inches tall and the first pocket and the second pocket are approximately 3 inches deep.

7. The towel system of claim 1, wherein the pockets are sewn into place.

8. The towel system of claim 1, wherein towel is made from one or more of cotton, polyester or nylon.

9. The towel system of claim 1, wherein the towel further comprises antimicrobial materials.

10. The towel system of claim 1, wherein the towel further comprises moisture management to remove perspiration from a user.

11. The towel system of claim 1, wherein the towel further comprises cooling technology to provide a cooling effect to a user.

* * * * *